United States Patent [19]

Meuresch et al.

[11] Patent Number: 4,723,692

[45] Date of Patent: Feb. 9, 1988

[54] SPRAY VALVE ARRANGEMENT

[75] Inventors: Herbert Meuresch, Wiesbaden; Louis Pericard, Hattersheim, both of Fed. Rep. of Germany

[73] Assignee: Deutsche Prazisions Ventil GmbH, Hattersheim, Fed. Rep. of Germany

[21] Appl. No.: 37,097

[22] Filed: Apr. 9, 1987

Related U.S. Application Data

[63] Continuation of Ser. No. 716,993, Mar. 28, 1985, abandoned, which is a continuation of Ser. No. 281,090, Jul. 7, 1981, abandoned.

[30] Foreign Application Priority Data

Aug. 7, 1980 [DE] Fed. Rep. of Germany ..... 3025725

[51] Int. Cl.[4] ..... B65D 83/00

[52] U.S. Cl. ..... 222/402.19; 137/38

[58] Field of Search ..... 222/402.1, 402.19, 402.18, 222/402.24; 137/38, 43

[56] References Cited

U.S. PATENT DOCUMENTS 3,315,693 4/1967 Braun ..... 137/43

3,542,254 11/1970 Samuelson et al. ..... 222/402.19

FOREIGN PATENT DOCUMENTS 2058229 4/1981 United Kingdom ..... 222/402.19

*Primary Examiner*—Joseph J. Rolla

*Assistant Examiner*—Kenneth Noland

*Attorney, Agent, or Firm*—Davis Hoxie Faithfull & Hapgood

[57] ABSTRACT

A spray valve assembly for an aerosol container comprising a valve housing which can be sealingly fixed into the top of the container, the housing defining a main passage for the throughflow of the contents of the container, a valve stem within the housing forming the main valve, an immersion pipe extending from the main passage in the housing, a secondary passage communicating the container and the main passage in the housing for the throughflow of the contents of the container when the container is inverted, an auxiliary valve disposed between the secondary and main passages, which auxiliary valve is disposed eccentrically within the valve housing.

15 Claims, 9 Drawing Figures

Figure 2:
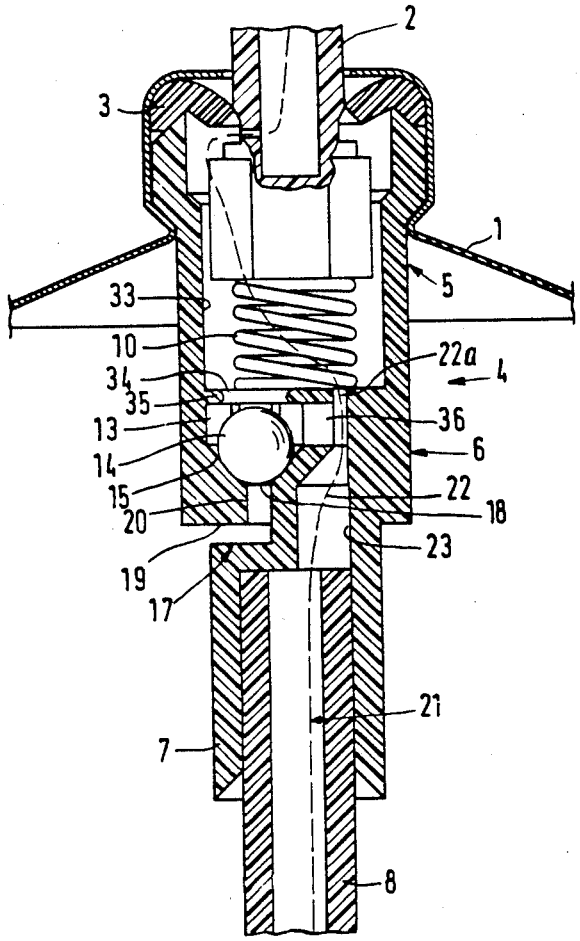

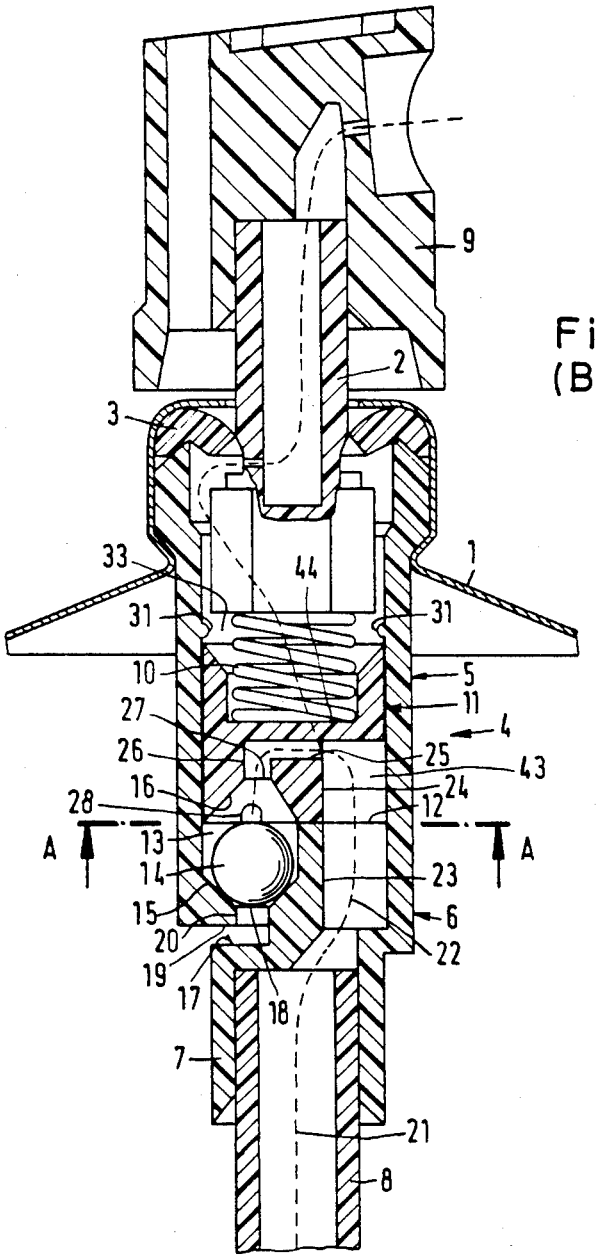
Fig.1
(B-B)
Fig.1a
(A-A)
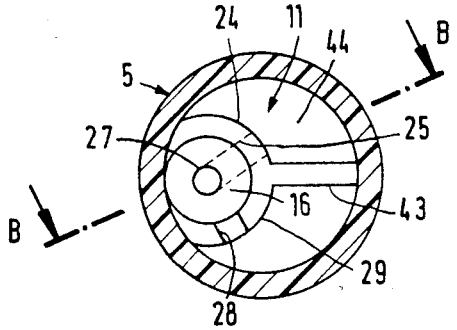

SPRAY VALVE ARRANGEMENT

This application is a continuation of Ser. No. 716,993 filed on Mar. 28, 1983 and now abandoned and which is a continuation of Ser. No. 281,090 filed on July 7, 1981 and now abandoned.

This invention relates to a spray valve assembly for an aerosol can, comprising a one-piece valve housing of plastics material, which can be sealingly fixedly fitted with an upper end in the top portion of the can, which defines a main passage for the throughflow of the contents of the can, and which has a main valve with a valve stem, which is manually actuable against the force of a spring, in the main passage, an immersion pipe which extends the main passage, a secondary passage which connects the space in the can to the main passage, for the throughflow of the contents of the can above the maximum level of filling of the can, and a valve seat of an auxiliary valve which is formed at the junction of the main and the secondary passages, having a valve ball of metal in an auxiliary valve chamber which is surrounded by an outer valve housing portion, wherein the auxiliary valve seat is disposed below the valve ball so that in the normal position of the can the valve ball does not impede the main passage and blocks the secondary passage whereas in the inverted position of the can it opens the secondary passage, and wherein the main passage is taken laterally past the auxiliary valve.

In a known spray valve assembly of this kind (U.S. Pat. No 3,447,551,) the auxiliary valve chamber is disposed concentrically with respect to the valve housing. The section of the main passage which is taken laterally past the auxiliary valve is therefore necessarily of very small flow cross-section, which is detrimental to flow therethrough, over its entire length, because of the predetermined external valve dimensions. As the dimensions of the valve housing must also be kept to a minimum, in consideration of the minimum possible consumption of material in cans of this kind which are produced in large numbers, the flow resistance in the above-mentioned section of the main passage is comparatively high. This results in a pressure drop which has an undesirable and detrimental effect on the spray action of the valve assembly. The upper opening of the auxiliary valve chamber, which is provided for installation of the auxiliary valve ball, is closed by a second ball which is subjected to the pressure of the return spring of the main valve stem. Therefore, the auxiliary valve ball is pressed downwardly on to its valve seat by the propellent or pressure gas which is above the level of liquid in the can and which passes into the auxiliary valve chamber by way of the secondary passage, so that the communication between the secondary and main passages is interrupted in the normal position of the can and the pressure gas cannot flow out of the head space in the can. In the inverted position of the can, on the other hand, the auxiliary valve ball falls downwardly so that the secondary passage is now connected to the main passage and the fluid can pass by way of the secondary passage to the main passage and can be discharged by way of the main passage. Without special steps being taken at the same time however, the pressure gas can also flow out of the arrangement through the main passage. In that case, in the normal position, the discharge pressure available is no longer sufficient, for the remaining fluid in the can.

The invention is based on the problem of providing a spray valve assembly of the general kind set forth, whose design complies with the requirements of mass production and which in particular ensures low levels of discharge pressure losses.

According to the invention, this problem is solved in that the auxiliary valve is formed eccentrically in the outer valve housing portion which surrounds the auxiliary valve chamber and that the predominant part of the cross-section of the section of the main passage which extends beside the auxiliary valve is disposed [within the valve housing on the side opposite the axis of the valve housing from that of the valve axis of the auxiliary valve chamber.]

This configuration ensures that the flow cross-section of the main passage, relative to the outside diameter of the housing, is increased in the comparatively long section which goes past the auxiliary valve. In this section therefore, the flow resistance and thus the flow losses are lower, in comparison with a concentric arrangement when the outside diameter of the housing is otherwise the same. Consequently, with the same pressure, the fluid can be discharged from the can at higher speed and consequently in a more finely atomised form. The arrangement ensures nonetheless that the auxiliary valve ball, the diameter of which is only slightly less than the inside diameter of the auxiliary valve chamber, cannot be introduced upon assembly into the main passage beside the auxiliary valve chamber. It is then desirable for the degree of eccentricity to be approximately equal to the difference between the inside radii of the outer valve housing portion and the auxiliary valve chamber. In this respect, the outside wall of the outer valve housing portion simultaneously forms a part of the wall of the auxiliary valve chamber. This not only provides a clear saving of material but also results in a further reduction in pressure losses.

Preferably, the invention provides that the difference between the outside diameter of the auxiliary valve chamber and the inside diameter of the outer valve housing portion is less than the diameter of the ball of the auxiliary valve. This facilitates assembling the ball of the auxiliary valve. It only needs to be put into the valve housing which is open at the upper end, and nonetheless aligns itself automatically above the insertion opening of the auxiliary valve chamber, without it having to be held beforehand, at a position with the same degree of eccentricity as that of the auxiliary valve chamber, in the desired position of installation.

The opening of the secondary passage into the auxiliary valve chamber may be below the ball. If in this respect possible escape of the pressure gas upon actuation of the main valve in the inverted position of the can is tolerated, then it is possible to omit a shut-off ball or the like for the ball insertion opening of the auxiliary valve chamber. As aerosol cans are produced in large numbers, the omission of a single component means that, in the ultimate analysis, there is a considerable saving in regard to the costs of material and assembly, in comparison with the previously known design. The weight of the ball of the auxiliary valve is sufficient, if the valve is of the appropriate dimensions, for reliably interrupting the communication between the secondary and the main passages when the main valve is actuated in the normal position of the aerosol can.

Although in principle it is possible for the secondary passage to open in the conical surface of the auxiliary valve seat, it is better for the mouth of the secondary passage to end at the lowest position of the auxiliary valve seat. In this arrangement, when the aerosol can is in the normal vertical position, the ball closes the auxiliary valve against the gas pressure, not just with a component of the force produced by its weight, but with its full weight.

If the valve is retained in the auxiliary valve chamber by a retaining means which is disposed above the ball, so that the ball cannot fall out of the valve chamber in the inverted position, the retaining means may liberate an assembly opening for the ball from the space in the housing for the main valve, to the auxiliary valve chamber. There is no need to have an additional component to provide the retaining means. Nonetheless, this arrangement ensures that not only can the ball be easily introduced into the auxiliary chamber upon assembly, but in addition the fluid can be discharged through the auxiliary valve chamber, by way of a comparatively large flow cross-section, when the main valve is actuated in the inverted position of the can.

If the opening is parallel to the axis and the retaining means is formed by at least one flexible projections which projects radially inwardly at the opening, the ball can be easily pressed beyond the projections into the auxiliary valve chamber, upon assembly.

Instead of securing the ball in the auxiliary valve chamber by the above-mentioned retaining means, it is also possible to provide a housing insert which defines the chamber and which preferably has regulation or control apertures for the flow path outside of the chamber, which apertures may be larger or smaller depending on the intended purpose of the spray valve.

Preferably, the valve housing has a projection which extends in an annular configuration on its inside wall, and the housing insert can be pushed beyond the projection upon assembly and can be brought into detent engagement therebehind for securing it in position in the axial direction. The spring which is provided for returning the main valve stem bears against the housing insert. This arrangement additionally ensures that the housing insert is sealingly applied against the upper wall of the chamber of the auxiliary valve.

It is also advantageous for the cross-section of the narrowest part of the secondary passage to be greater than that of the narrowest part of that section of the main passage which adjoins the secondary passage in the direction of flow, within the valve housing. This arrangement provides a guarantee in respect of any loss of gas from the container, even when the container is in the inverted position, as more fluid can always flow into the main passage by way of the secondary passage, then can flow away below the opening of the secondary passage into the main passage.

Then, in a further embodiment, in an arrangement including a housing insert which delimits the auxiliary valve chamber, the housing insert may have a second auxiliary valve seat above the ball and may surround an opening of the main passage into the auxiliary valve chamber. In this connection, this arrangement also ensures in the inverted position of the can that the same ball closes the opening of the main passage into the auxiliary valve chamber, by virtue of the weight of the ball itself, so that the pressure gas cannot flow out before the level of liquid in the container has not fallen at least to below the inlet opening of the secondary passage into the valve housing, in the inverted position. If in the normal position the secondary passage opens from below and the main passage opens from above, into the auxiliary valve chamber, the flow pressure of the fluid which flows out by way of the auxiliary valve chamber when the main valve is opened, together with the weight of the ball itself, acts against the ball being lifted from the valve seat by the gas pressure, irrespective of whether the aerosol can is held in the normal vertical position or in the reverse position (inverted).

It is also advantageous, in the change-over switching valve, for the opening of the secondary passage in the first auxiliary valve seat and the opening of the main passage in the second auxiliary valve seat to be coaxial with respect to each other. In this way, the fluid flow pressure upon discharge acts precisely in opposition to the gas pressure on the valve ball so that the flow pressure is fully effective to act as a closing pressure, to prevent a discharge of gas. At the same time this arrangement ensures that the ball only needs to be put into the upper opening of the valve housing for it nonetheless to be put precisely centrally on the lower valve seat of the auxiliary valve before the housing insert is inserted into the position of installation.

Preferably, the valve housing has a transversely extending slot and an axial bore, which form the secondary passage. In production of the valve housing which comprises plastics material, it is therefore only necessary to provide a simple plate-like slide member for the transverse slot and a cylindrical round mandrel for the axial bore, on the core means of the mould. The mandrel may lie with its end face against the plate, giving a large contact area, in contrast to an arrangement of two cylindrical bores which are at an angle to each other, wherein it would be necessary to have a correspondingly cylindrical slide member which would come into only line contact with a flat end face of the core mandrel, so that said end face would have to be of a correspondingly cylindrical configuration, which is expensive, in order to provide for a large-area flow cross-section between the two bores.

Then, the invention preferably provides that the main pressure is provided, below the junction of the main passage and the secondary passage, with a second eccentric valve having a second valve ball of metal and a second auxiliary valve seat above the second ball. In this way, discharge of gas is prevented by the first or second valve ball, not just in the normal position but also in the inverted position of the can. In this arrangement however a housing insert may be omitted.

In this connection, it is desirable for the auxiliary valves to be axially displaced and to overlap radially. In this way, the flow cross-section in respect of the main passage is maintained, even with a small outside diameter in respect of the valve housing and two auxiliary valves.

The ratio of the inside diameter of the outer valve housing portion to the diameter of the first valve ball may be in the region of from 1.5 to 2 and is preferably 1.75. Relative to the maximum diameter of the valve housing, this gives a comparatively large ball which is of correspondingly high weight, which provides for a good and reliable closure effect.

A particularly advantageous form of the arrangement is one in which the inlet opening of the secondary passage is in the direct vicinity of the top portion of the can. In this arrangement, virtually the entire fluid can be discharged from the can, without residue, in the inverted position of the can, because the inlet opening of the secondary passage occupies the lowest position in the can (in the inverted position). This low position of the inlet opening of the secondary passage may be achieved for example by the inlet of the secondary passage into the auxiliary valve chamber being formed as an axial bore in the outside wall of the valve housing. However, a simpler construction may provide that an initial section of the secondary passage is formed by a groove which is provided in the outside of the valve housing and which begins at the inside of the top portion of the can and which is covered as far as into the vicinity of the top portion of the can, by the immersion pipe which is pushed over the valve housing. It is easier to produce a groove in a plastics housing, than a bore.

The auxiliary valve chamber or both auxiliary valve chambers may be partially delimited by two housing inserts. This not only simplifies the production of the valve housing but, in the case of two auxiliary valve chambers, it also facilitates inserting the valve balls only from one open side of the valve housing.

Figure 3:
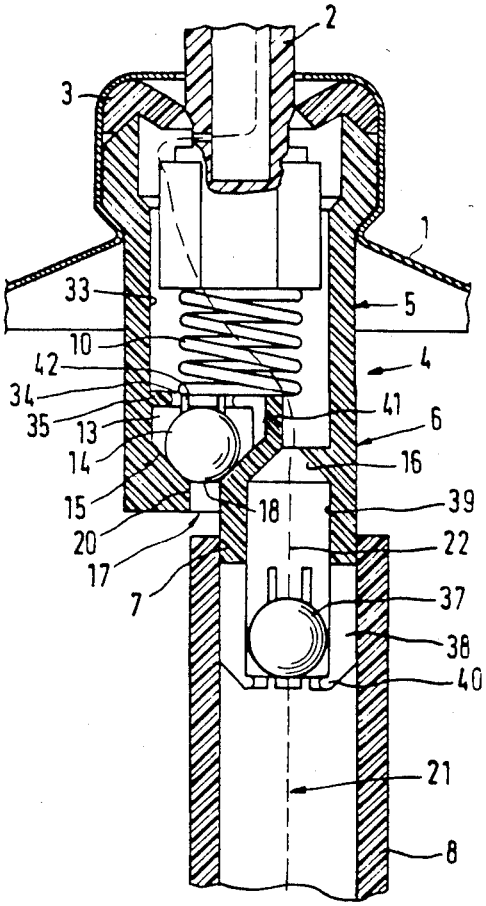
Figure 4:
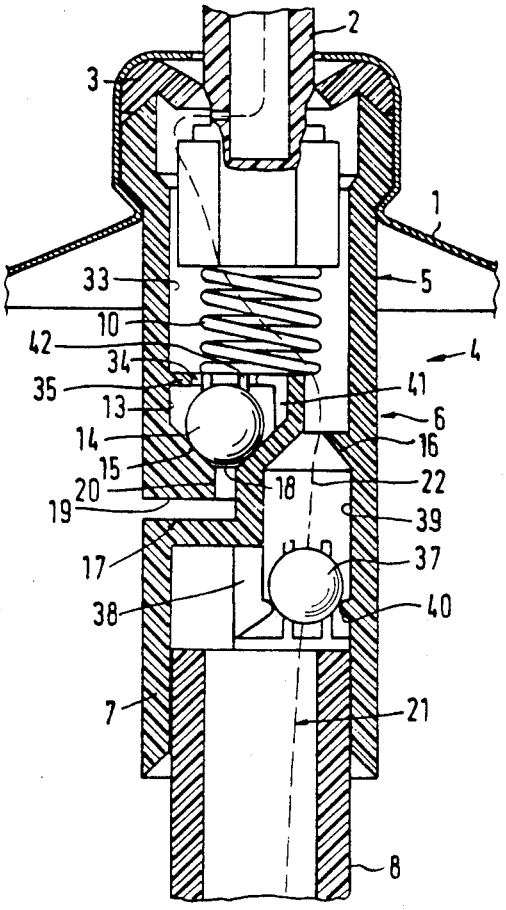
Figure 6:
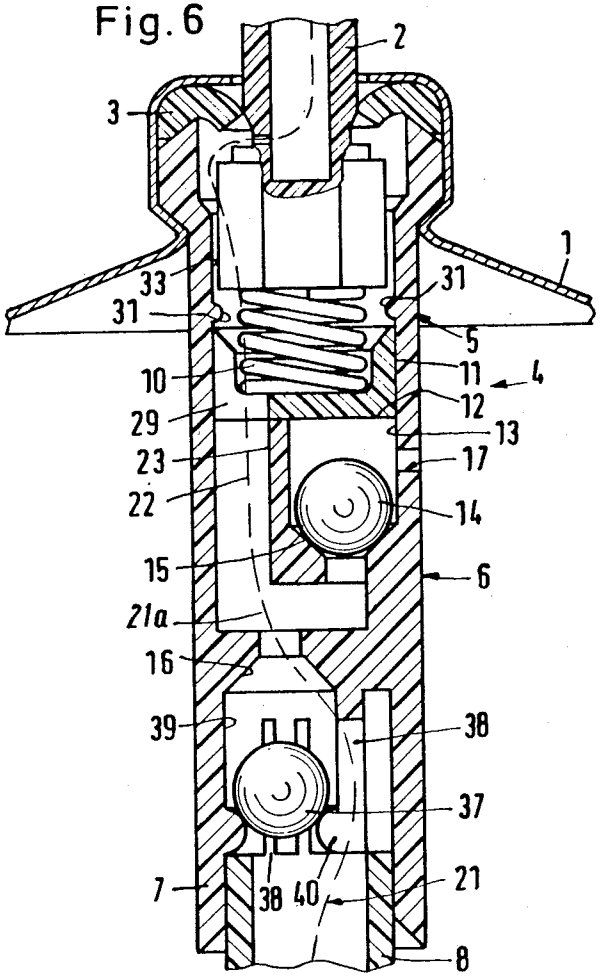
Figure 5:
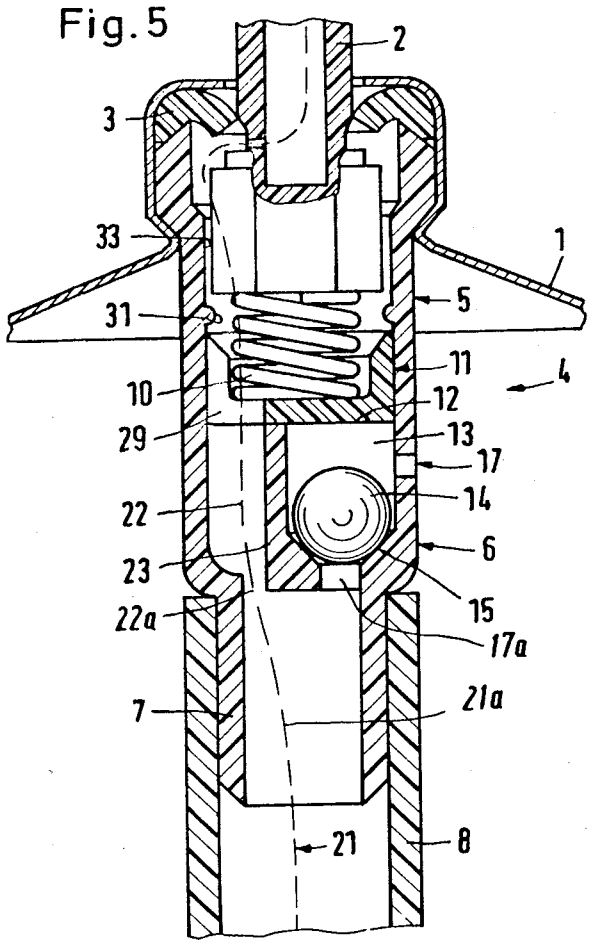
Figure 8:
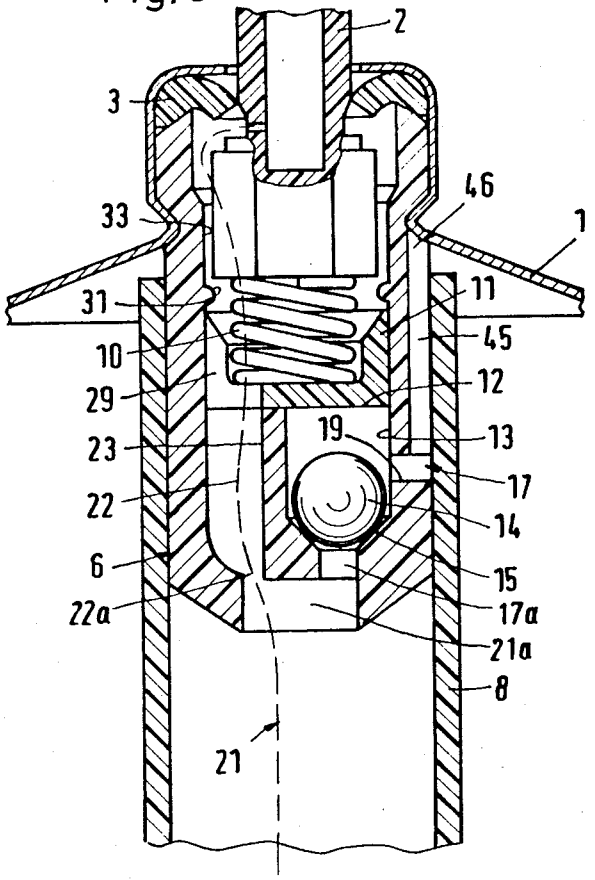
Figure 7:
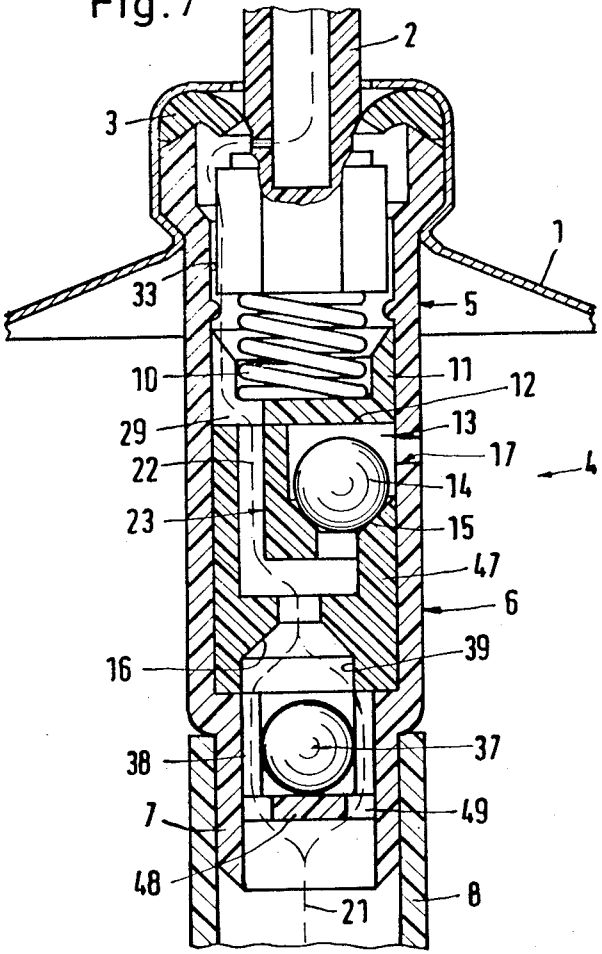

The invention and developments thereof are described in greater detail hereinafter with reference to the drawing of preferred embodiments, in which:

FIG. 1 shows a first embodiment of a spray valve assembly according to the invention, having an eccentric auxiliary valve which has only one valve ball and which acts as a change-over switching valve with two valve functions, in the normal vertical position, in axial section taken along line B—B of FIG. 1*a*, FIG. 1*a* shows a view in section taken along line A—A in FIG. 1, FIG. 2 shows a view in axial section of a part of a second embodiment of a spray valve assembly according to the invention, having an eccentric auxiliary valve which has only one valve function, in the normal vertical position, FIG. 3 shows a view in axial section of a part of a third embodiment of a spray valve assembly according to the invention having two eccentric auxiliary valves, in the normal vertical position, FIG. 4 shows a view in axial section of a part of the fourth embodiment of a spray valve assembly according to the invention having two eccentric auxiliary valves in the normal vertical position, FIG. 5 shows a view in axial section of a fifth embodiment of a spray valve assembly according to the invention having only one eccentric auxiliary valve in the normal vertical position, FIG. 6 shows a view in axial section of a part of a sixth embodiment of a spray valve assembly according to the invention having two eccentric auxiliary valves in the normal vertical position, FIG. 7 shows a view in axial section of a part of a seventh embodiment of a spray valve assembly according to the invention having two eccentric auxiliary valves, in the normal vertical position, and FIG. 8 shows a view in axial section of a part of an eighth embodiment of a spray valve assembly according to the invention having only one eccentric auxiliary valve in the normal vertical position.

In the embodiment shown in FIGS. 1 and 1*a*, fitted in a top portion 1 (only part of which is shown) of an aerosol can is a valve which is shown in an open position, having an actuating valve stem 2 of which part is shown in the sectional view, a closure member 3 in the form of a resilient annular disc, and a valve housing 4 comprising plastics material.

The valve housing 4 has an upper valve housing portion 5 and a lower valve housing portion 6 which are integrally connected together.

The upper valve housing portion 5 is sealingly flanged or beaded in position in the top portion 1 of the can. The lower valve housing portion 6 has a connecting nipple 7 for an immersion pipe of which only part is shown and which projects into the vicinity of the bottom of the can, into the contents of the can, and which is open at the bottom.

The valve stem 2 is guided by means of its lower thicker end which has vertical ribs on its exterior, in the upper valve housing portion 5, while its upper end is seated in a main valve actuating head 9 which has a spray opening.

The lower end of the valve stem 2 is supported in a housing insert 11 by way of a spring 10 for return movement of the valve stem 2, and the lower end of the valve stem 2 presses the housing insert 11 sealingly against an internal shoulder 12 on the lower valve housing portion 6.

Together with the lower valve housing portion 6, the housing insert 11 defines an auxiliary valve chamber 13 of an auxiliary valve which operates as a change-over switching valve and which comprises a valve ball 14 of metal, preferably steel, a first frustoconical valve seat 25 below the ball 14 in the lower valve housing portion 6, and a second frustoconical valve seat 16 above the ball 14 in the housing insert 11.

A secondary passage 17 which in the vertical position of the valve assembly, as illustrated, is disposed above the maximum level of filling of the can, communicates the region of the interior of the can which is filled with pressure gas with the lower valve seat 15, in the illustrated vertical position, with the opening 18 of the secondary passage 17 being disposed at the lowest position of the valve seat below the ball 14. In the initial part thereof, the secondary passage 17 is in the form of a transversely extending or horizontal slot 19 which goes into a vertical bore 20.

The path of the main passage 21 for the throughflow of the contents of the can is shown as a broken line. A part 22 of the main passage 21 extends laterally beside the auxiliary valve through an axial passage 23 in the lower valve housing portion 6, an axial groove 24, a radial bore 25 and an axial bore 26 in the housing insert 11, to an opening 27 which is coaxial with respect to the opening 18, above the ball 14, in the upper valve seat 16. The main passage continues by way of a radial recess 28 in the form of a groove in the wall of the housing insert 11 and an axial groove 29 which is also provided in the housing insert 11. The grooves 28 and 29 form a direct throughflow passage from the auxiliary valve chamber 13 to the main valve space 33 in the housing. In order to ensure, upon assembly, that the passage 23 and the groove 24 are aligned with each other, an axial projection on the underside of the housing insert 11 may engage into a recess at the top of the shoulder 12.

The top portion of the housing insert 11 is in the form of a cup into which the spring 10 engages.

A radial detent projection 31 on one inward face and on the diametrically opposite inward face of the upper valve housing portion 5, which can also be in the form of a peripherally extending annular projection, engages directly over the upper edge of the housing insert 11 in order to secure the housing insert 11 in position in the axial direction; when the housing insert 11 is fitted into place, the projection 31 may be compressed radially outwardly thereby to such an extent that the housing insert 11 can be moved past the projection 31.

The auxiliary valve chamber 13 is disposed eccentrically with respect to the outer portion of the valve housing 4 or the valve housing portion 6. The degree of eccentricity is approximately equal to the difference between the inside radii of the auxiliary valve chamber 13 and the valve housing portion 6 so that the outside wall of the valve housing portion 6 simultaneously forms a part (the part on the left in FIG. 1) of the wall of the auxiliary valve chamber 13.

The axial grooves 24 and 29 are separated by a wall 43 which bears with its radially outward edge sealingly against the inside of the upper portion 5 of the valve housing. The groove 29 is open upwardly whereas the groove 24 is closed upwardly by the transverse wall 44 of the insert 11.

By virtue of the eccentricity of the auxiliary valve chamber 13, the main passage section 22 is of larger flow cross-section than when the auxiliary valve chamber 13 and the valve housing 4 form a concentric arrangement. Furthermore, the amount of material required for the valve housing 4 is less than in a concentric arrangement.

Then, the difference between the outside diameter of the auxiliary valve chamber 13 and the inside diameter of the valve housing 6, at the level of the auxiliary valve chamber, is less than the diameter of the ball 14 so that, in the assembly operation, the ball can be simply thrown into the valve housing 4 from above, before the housing insert 11 is fitted into place, and can be easily pressed into the auxiliary valve chamber 13, without special guide means, for example by means of a pressing punch, in spite of the eccentricity of the auxiliary valve chamber 13.

In the normal vertical position of the aerosol can or valve assembly as illustrated in the drawing, the weight of the ball 14 causes the ball 14 to close off the secondary passage against the gas pressure so that the gas cannot escape. On the other hand, it opens the main passage 21 at the opening 27 so that the fluid in the can can issue from the can under the gas pressure by way of the main passage if the main valve has been opened by depression of the head 9, as illustrated.

If on the other hand, when the main valve 9 is opened, the can is held in an inverted position, that is to say, with the head 9 downwardly, so that the secondary passage 17 is immersed in the fluid whereas the inlet opening of the pipe 8 is above the level of fluid in the can, then the ball 14 rolls against the valve seat 16 so that, when the can is in this position, only fluid and not pressure gas can be discharged by way of the secondary passage 17, the auxiliary valve chamber 13 and the grooves 28 and 29.

In the embodiment of the spray assembly according to the invention, as shown in FIG. 2, and all subsequent embodiments, the main valve actuating head 9 shown in FIG. 1 is omitted for the sake of greater simplicity of the drawing. Insofar as the parts of the assembly correspond to those shown in FIG. 1, they are denoted by the same reference numerals.

The embodiment of FIG. 2 differs from that shown in FIG. 1 substantially in that the auxiliary valve is operative only in one direction and a wider straight passage 34 from the auxiliary valve chamber 13 to the main valve space 33 in the housing is provided.

The inside diameter of an inwardly projecting annular bead 35 which delimits the passage 34 at the upper open edge of the auxiliary valve chamber 13 is somewhat smaller than the diameter of the valve ball 14 so that the annular bead acts as a retaining means to ensure that the ball does not escape from the auxiliary valve chamber 13 under the pressure of the fluid which presses against the ball by way of the auxiliary passage 17.

With the spray valve assembly of FIG. 4 in the normal position illustrated, the fluid in the can flows out of the can by way of the immersion pipe and through the main passage 21, under the pressure of the gas above the fluid in the can, when the main valve 2, 3 is opened, while the valve ball 14 holds the auxiliary valve in a closed condition, by virtue of the weight of the ball itself, so that the pressure gas cannot escape by way of the secondary passage 17. In the inverted position of the can on the otherhand, when the main valve is opened, the fluid can issue by way of the secondary passage 17 as the ball 14 is now lifted from the valve seat 15. In this case, the fluid which is urged into the auxiliary valve chamber 13 by way of the secondary passage 17 discharges by way of lateral slots 36 in the wall of the auxiliary valve chamber 13 into the main valve housing portion 33.

Although in the embodiment of FIG. 2, in the inverted position of the can, the pressure gas can in part also escape by way of the main passage 21, nonetheless this embodiment is simpler in regard to manufacture and assembly, because there is no housing insert 11.

In the embodiment of FIG. 3 however, the installation of a second auxiliary valve having a second ball 37 in the main passage section 22 also prevents the pressure gas from escaping from the can by way of the main passage 21 in the inverted position of the can. In order to permit discharge of the fluid in the normal position illustrated, the nipple 7 is provided at the lower end with slots 38 which extend continuously down to the bottom, while the wall portions of the second auxiliary valve chamber 39, which define the slots 38, have projections 40 which project radially inwardly at the lower edge of the opening, to act as a retaining means to prevent the valve ball 37 from coming out. The pipe 8 which is pushed over the nipple 7 closes the slots 38 in an outward direction.

In a modification of the embodiment of FIG. 2, the wall of the auxiliary valve chamber 13 is not provided with radial slots 36 but with axial ribs 41 which define between them slots 42 which extend axially to the upper edge of the opening of the auxiliary valve chamber 13. Just like the single valve chamber 13 of the embodiment of FIG. 2, the two auxiliary valve chambers 13 and 39 are arranged eccentrically and diametrically opposite each other. Because of the eccentric design of the nipple, the slot 19 is completely omitted. The auxiliary valve chambers are then axially displaced, while overlapping in the radial direction.

The only difference between the embodiment of FIG. 4 and that shown in FIG. 3 is as follows: the lower valve housing portion 6 and thus the nipple 7 are of larger diameter than in the embodiment of FIG. 3 so that the immersion pipe 8 can be inserted into the nipple 7 and the second auxiliary valve chamber is partly surrounded by the valve housing portion 6.

The embodiment shown in FIG. 5 differs from that shown in FIG. 2 in that, instead of the retaining means 35, there is an insert 11 with a throughflow groove 29 which defines the main passage, the insert closing the auxiliary valve chamber 13 under the pressure of the spring 10. The secondary passage 17 opens above the valve ball 14 into the auxiliary valve chamber 13. The housing insert provides at the same time for sealing the auxiliary valve chamber 13 in the normal position illustrated, in which the pressure gas passes into the auxiliary valve chamber 13 by way of the secondary passage 17 and presses the ball 14 against the valve seat 15, in addition to the weight of the ball itself. At the same time the housing insert 11 ensures that the ball 14 remains in its position of installation during assembly.

The embodiment of FIG. 6 differs from that shown in FIG. 5 by using a second auxiliary valve 16, 37 which is of a similar design to the second auxiliary valve of FIG. 4. In this respect therefore it has the same function as the embodiment of FIG. 4.

The embodiment of FIG. 7 differs from the embodiment of FIG. 6 in principle only in that a second housing insert 47 forms an inner valve housing portion which delimits the first valve chamber 13 and the second valve chamber 39 in part, and the main passage 22. This simplifies manufacturing the valve housing 4 from plastics material and facilitates insertion of the second ball 37 in a downward direction, that is to say, insertion in the same direction as the direction of insertion of the first ball 14 so that the valve housing 14 does not need to be turned in the assembly operation. In this case, a middle holding member 48 which is connected to the wall of the nipple 7 by radial limb portions 49 corresponds to the lower retaining means 40. The slots 38 are formed by spaces between axial ribs.

FIG. 8 shows a modification of the embodiment of FIG. 5 in which an axial groove 45 is provided in the outside of the valve housing 14, forming an initial section of the secondary passage 17 and beginning at the inside of the top portion of the can. The groove 45 is covered by the immersion pipe 8, as far as a position in the vicinity of the top portion 1 of the can, so that an inlet opening 46 remains free. If, with this embodiment, the can is held in the inverted position, virtually all the fluid can escape from the can by way of the secondary passage 17 without any residue worth mentioning remaining in the can, as the inlet opening 46 is virtually at the lowest position in the inverted condition of the can. A further advantage of this embodiment over that shown in FIG. 5 is that the nipple 7 can be omitted.

If, with the valve assemblies shown in FIGS. 2, 5 and 8, very high spray quantities per unit of time have to be produced, without a loss of pressure gas when the container is inverted, then it is desirable to use the above-described assemblies shown in FIGS. 1, 3, 4,6 and 7. If however sufficient effects can be achieved with a low spray rate, it is possible not to use these more expensive assemblies. The embodiments of FIGS. 2, 5 and 8 can also be used to spray without losing pressure gas when the container is inverted, if, in the flow region of the auxiliary valve, the narrowest part of the passages 17, 20, 36 (FIG. 2) or 45, 17, 17*a* (FIGS. 5 and 8) is provided with a larger cross-section than the narrowest part of the main passage region 22*a* (FIG. 2) or 22*a*, 22 and 29 (FIGS. 5 and 8), which is adjacent in the direction of flow.

The following dimensions are preferred in the illustrated embodiment:

Diameter D of the ball 14, 37: 3 to 4.5 mm, preferably 3.5 mm;

Inside diameter of the outer housing portions 5, 6: 6 to 9 mm, preferably 6.9 mm when D=3.5 mm;

Minimum width of the passage 21: 1.5 mm;

Inside diameter of the auxiliary valve chamber 13, 39: 3.75 mm when D=3.5 mm;

Thickness of the wall of the auxiliary valve chambers 13, 39 which does not coincide with the outer housing portion 6: 0.7 to 0.8 mm when D=3.5 mm;

Radial depth of the grooves 23, 24 and 29 in FIG. 1; 0.8 mm when D=3.5 mm.

Modifications in respect of the illustrated embodiments are within the scope of the invention. Thus the walls of the auxiliary valve chambers in FIGS. 3 and 4 may be of the same design as the wall of the auxiliary wall chamber 13 of FIG. 2, and vice-versa. Furthermore, the walls of the auxiliary valve chamber 13 of FIGS. 2 to 14 may also be provided with slots 38, like the wall of the auxiliary wall chamber 39 of FIG. 3, and vice-versa.

We claim:

1. In a spray valve assembly for an aerosol container which can be sealingly and fixedly fitted in the upper portion of the container, the valve assembly having a plastic one-piece housing, a main passage for the throughflow of the contents of the container, a main valve including a valve stem which is manually actuatable against the force of a spring in the main passage, an immersion tube extending from the main passage in the valve assembly and into the container, a secondary passage including an inlet opening in the outer wall of the housing which connects the space in the container to the main passage for the throughflow of the contents of the container, and an auxiliary valve capable of sealing the secondary passage, the auxiliary valve having a gravitationally-responsive movable sealing member and having an auxiliary valve seat, wherein the auxiliary valve seat is disposed below its valve sealing member so that in the normal position of the container the gravitationally-responsive sealing member does not impede the main passage and blocks the secondary passage, and wherein in the inverted position of the container the auxiliary valve opens, and wherein the main passage is taken laterally past the auxiliary valve, the improvement which comprises disposing the auxiliary valve, which is surrounded by and formed in part by a cylindrical valve housing portion, eccentrically within the one-piece housing and having the wall of the auxiliary valve formed in part by an inner wall of the cylindrical valve housing portion which surrounds the valve stem, the degree of eccentricity being approximately equal to the difference between the inside radii of the cylindrical valve housing portion and the auxiliary valve and further having the difference between the outside diameter of the auxiliary valve chamber and the inside diameter of the cylindrical valve housing portion less than the diameter of the gravitationally-responsive member of the auxiliary valve.

2. An assembly according to claim 1, and further wherein the inlet opening of the secondary passage into the auxiliary valve chamber is below the valve ball.

3. An assembly according to claim 2, and further wherein the valve housing has a transversely extending slot and an axial bore, which form the secondary passage.

4. An assembly according to claim 1, and further wherein the outlet opening of the secondary passage opens, from the lowest position of the auxiliary valve seat, into the space of the main passage in the housing, which is below the valve ball.

5. An assembly according to claim 1, wherein the valve ball is retained in the auxiliary valve chamber by a retaining means which is disposed above the valve ball, and further wherein the retaining means liberates a through assembly opening for the valve ball from the space in the housing for the main valve, to the auxiliary valve chamber.

6. An assembly according to claim 5, and further provided that the through assembly opening is disposed parallel to the axis of the auxiliary valve and the retaining means is formed by at least one flexible projection which projects radially inwardly at said opening.

7. An assembly according to claim 1, and provided further that the cross-section of the narrowest part of the secondary passage is larger than that of the narrowest part of that section of the main passage which adjoins the secondary passage in the direction of flow, within the valve housing.

8. An assembly according to claim 1, and further provided that the main passage is provided, below the junction of the main and secondary passages with a second eccentric auxiliary valve having a second valve ball of metal, and a second auxiliary valve seat above the second ball.

9. An assembly according to claim 8 and further provided that the auxiliary valves are axially displaced and overlap each other radially.

10. An assembly according to claim 1, and further provided that the ratio between the inside diameter of the outer valve housing portion to the diameter of the first valve ball is in the range of approximately 1.5 to 2.

11. In a spray valve assembly for an aerosol container which can be sealingly and fixedly fitted in the upper portion of the container, the valve assembly having a plastic one-piece housing, a main passage for the throughflow of the contents of the container, a main valve including a valve stem which is manually actuatable against the force of a spring in the main passage, an immersion tube extending from the main passage in the valve assembly and into the container, a secondary passage including an inlet opening in the outer wall of the housing which connects the space in the container to the main passage for the throughflow of the contents of the container, and an auxiliary valve capable of sealing the secondary passage, the auxiliary valve having a gravitationally-responsive movable sealing member, wherein the auxiliary valve seat is disposed below the valve sealing member so that in the normal position of the container the gravitationally-responsive sealing member does not impede the main passage and blocks the secondary passage, and wherein in the inverted position of the container the auxiliary valve opens, and wherein the main passage is taken laterally past the auxiliary valve, the improvement which comprises disposing the auxiliary valve eccentrically within and having the wall of the auxiliary valve formed in part by the inner wall of the cylindrical valve housing portion which surrounds the valve stem, the degree of eccentricity being approximately equal to the difference between the inside radii of the cylindrical valve housing portion and the auxiliary valve and further having the difference between the outside diameter of the auxiliary valve chamber and the inside diameter of the cylindrical valve housing portion less than the diameter of the gravitationally-responsive member of the auxiliary valve; said assembly including a housing insert which delimits the auxiliary valve chamber and provides control apertures for a flow path outside of the auxiliary valve chamber.

12. An assembly according to claim 11, and further provided that the valve housing has a projection on its inside wall with which the housing insert can come into detent engagement.

13. An assembly according to claim 11 and further provided that the spring bears against the housing insert.

14. An assembly according to claim 11 and further provided that the housing insert has a second auxiliary valve seat above the ball and surrounds an opening of the main passage into the auxiliary valve chamber.

15. An assembly according to claim 14 and further provided that the opening of the secondary passage in the first auxiliary valve seat and the opening of the main passage in the second auxiliary valve seat are coaxial with each other.

* * * * *